US006546869B1

(12) United States Patent
Eltner et al.

(10) Patent No.: US 6,546,869 B1
(45) Date of Patent: Apr. 15, 2003

(54) METHOD OF OPERATING A PRINTING MACHINE, AND A PRINTING MACHINE FOR PERFORMING THE METHOD

(75) Inventors: Bruno Eltner, Heidelberg (DE); Bernd Müller, Nussloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/499,855

(22) Filed: Feb. 7, 2000

(30) Foreign Application Priority Data

Feb. 5, 1999 (DE) ..... 199 04 636

(51) Int. Cl.[7] ..... B41F 31/00

(52) U.S. Cl. ..... 101/483; 101/350.5; 101/352.01

(58) Field of Search ..... 101/350.1, 350.2, 101/350.3, 350.4, 363, 365, 367, 352.05, 158, 162, 352.01, 352.13, 425, 483, 484, 211, 218

(56) References Cited

U.S. PATENT DOCUMENTS

| | | | | | |
|---|---|---|---|---|---|
| 3,673,959 | A | * | 7/1972 | Jezuit et al. | 101/425 |
| 4,000,691 | A | * | 1/1977 | Fischer | 101/363 |
| 4,000,692 | A | * | 1/1977 | Wirz et al. | |
| 4,367,678 | A | * | 1/1983 | Fischer | 101/350.2 |
| 4,428,291 | A | * | 1/1984 | Dorow | 101/352.13 |
| 4,445,433 | A | | 5/1984 | Navi | |
| 4,559,874 | A | * | 12/1985 | Schuhmann et al. | 101/350.3 |
| 5,024,154 | A | * | 6/1991 | Ito | |
| 5,233,923 | A | * | 8/1993 | Fuchi | 101/484 |
| 5,477,783 | A | * | 12/1995 | Hashimura | 101/158 |
| 5,511,475 | A | | 4/1996 | Pfizenmaier | |
| 5,570,633 | A | * | 11/1996 | Schultz et al. | 101/182 |
| 5,676,055 | A | * | 10/1997 | Schwinn et al. | 101/216 |
| 5,921,184 | A | * | 7/1999 | Sugiyama et al. | 101/365 |
| 5,964,157 | A | * | 10/1999 | Hummel et al. | 101/483 |
| 5,983,793 | A | * | 11/1999 | Volz et al. | 101/218 |
| 6,055,907 | A | * | 5/2000 | Enokch et al. | 101/352.01 |
| 6,109,182 | A | * | 8/2000 | Vestman et al. | 101/424 |

FOREIGN PATENT DOCUMENTS

| | | |
|---|---|---|
| DE | 1 808 909 | 6/1970 |
| DE | 1 303 606 | 5/1972 |
| DE | 44 04 989 C2 | 8/1995 |
| DE | 44 23 286 C2 | 1/1996 |
| DE | 195 20 841 A1 | 12/1996 |
| DE | 196 11 048 A1 | 9/1997 |
| DE | 196 25 029 A1 | 1/1998 |
| DE | 298 07 386 U1 | 9/1998 |
| DE | 298 19 744 U1 | 3/1999 |
| EP | 0 518 084 A1 | 12/1992 |
| EP | 0 813 963 A1 | 12/1997 |
| GB | 1158056 | 7/1969 |

* cited by examiner

*Primary Examiner*—Eugene H. Eickholt
(74) *Attorney, Agent, or Firm*—Laurence A. Greenberg; Werner H. Stemer; Gregory L. Mayback

(57) ABSTRACT

A method of operating a printing machine including a printing form cylinder and an inking unit for inking the cylinder, the inking unit having at least one inking unit roller rotatably driven at a speed different from the peripheral speed of the printing form cylinder, includes rotatably driving the at least one inking unit roller at the differential speed and at a relative speed that is different from the peripheral speed of the printing form cylinder, in time-dependence upon various operating states of the inking unit; and a printing machine for performing the method.

18 Claims, 2 Drawing Sheets

METHOD OF OPERATING A PRINTING MACHINE, AND A PRINTING MACHINE FOR PERFORMING THE METHOD

BACKGROUND OF THE INVENTION

Field of the Invention

The invention relates to a method of operating a printing machine, more particularly, a printing machine that includes a printing form or plate cylinder and an inking unit for inking the cylinder, the inking unit having at least one inking unit roller rotatably driven at a speed different from the peripheral speed of the printing form cylinder. The invention further relates to a printing machine for performing the aforementioned method, more particularly, a printing machine that includes a printing form or plate cylinder and an inking unit for inking the cylinder, the inking unit having at least one inking unit roller rotatably driven at a speed different from the peripheral speed of the printing form cylinder.

The published European Patent Document EP 0 813 963 A1 describes an offset printing device wherein ink applicator rollers are driven frictionally at differential speeds different from the peripheral speed of a form or plate cylinder by formlockingly or positively driven inking rollers, and it is possible for the formlockingly driven inking rollers to be changed over from a differential speed to a synchronous speed relative to the peripheral speed of the form cylinder, depending upon the subject and/or printing material to be processed. In this regard, it is noted that a formlocking connection is one which connects two elements together due to the shape of the elements themselves, as opposed to a forcelocking connection, which locks the elements together by force external to the elements.

Although the wear behavior of a dry planographic printing plate can be improved thereby in cases wherein no contamination or only slight contamination occurs, no different operating states of the inking unit are taken into consideration at the time when a shift or change-over is made to the synchronous speed.

For example, no consideration is given as to whether the inking rollers are rotating at the synchronous speed or at the differential speed that differs from the plate-cylinder speed, before ink runs into the inking unit or after an inking-unit cleaning.

Consequently, the disadvantages described hereinbelow result.

If the inking unit of the offset printing device is to be cleaned, it is possible for the ink applicator rollers to rest on the plate cylinder during the cleaning, so that the printing plate is indirectly cleaned simultaneously via the inking unit. Cleaning can be performed in a number of washing cycles, respectively, including feeding washing fluid into the inking unit, and subsequent doctoring of the washing fluid/printing ink mixture. The inking unit and the printing plate or form increasingly cleaner from washing cycle to washing cycle, as a result of which, rubber-covered inking-unit rollers are subjected to rapidly increasing wear because of the vanishing lubricating action of the printing ink between the inking unit rollers. Because the formlockingly or positively driven inking rollers of the offset printing device belonging to the prior art rotate at the differential speed during the cleaning, each ink applicator roller is subjected to increased abrasion that is virtually dry at the end of the cleaning, both at the first slippage point thereof formed with the plate cylinder, and at the second slippage point thereof formed with the inking roller driving the ink applicator roller frictionally. When special inks and the like specific to a printing job are used, inking units have to be cleaned several times a day, so that the wear stresses associated with each cleaning operation add up and, after a comparatively short service life, make it necessary to replace the worn inking-unit roller.

If ink is to be introduced into the inking unit of this offset printing device, it is conceivable to bring the ink applicator rollers thereof into contact with the printing plate only after the infeeding of the ink, however, in this case, the problem of dry abrasion of rubber-covered rollers in the inking unit likewise arises if a number of the formlockingly or positively driven inking rollers rotate at differential speeds which differ in amount relative to one another. If the inking unit runs for a given time without printing ink, and therefore nonlubricated, before entry of the ink, the formlockingly or positively driven inking rollers gradually wear away the rubber-covered rollers arranged therebetween in the roller train of the inking unit. The two slippage points are formed, in this case, by the respective rubber-covered roller together with a first and a second adjacent roller engaging the rubber-covered roller. The adjacent rollers can be directly the two inking rollers driven formlockingly or positively at different differential speeds, or rollers arranged between the formlockingly or positively driven inking rollers and the rubber-covered inking roller.

In a further offset printing device described in the published German Patent Document DE 196 25 020 A1, the problems described hereinbefore and caused by inking unit rollers stripping or running blind occur in the same way.

SUMMARY OF THE INVENTION

It is thus an object of the invention to provide an improved method for low-wear operation of a printing machine and to provide a printing machine by which the low-wear operation method is performed.

With the foregoing and other objects in view, there is provided, in accordance with one aspect of the invention, a method of operating a printing machine including a printing form cylinder and an inking unit for inking the cylinder, the inking unit having at least one inking unit roller rotatably driven at a differential speed different from the peripheral speed of the printing form cylinder, which comprises rotatably driving the at least one inking unit roller at the differential speed and at a relative speed that is different from the peripheral speed of the printing form cylinder, in time-dependence upon various operating states of the inking unit.

In accordance with another mode, the method of the invention includes driving the inking unit roller at the differential speed and at a synchronized speed in time-dependence upon various operating states of the inking unit.

In accordance with a further mode, the method of the invention includes driving the inking unit roller at the differential speed in a first operating state and at the synchronized speed in a second operating state, depending upon the ink content of the inking unit, which is different in the respective operating states.

In accordance with an added mode, the method of the invention includes driving the inking unit roller at the synchronized speed when the inking unit is running virtually without ink, and at the differential speed when the inking unit is running with ink.

In accordance with an additional mode, the method of the invention includes driving the inking unit roller at the differential speed and at a different differential speed in time-dependence upon the various operating states of the inking unit.

In accordance with yet another mode, the method of the invention includes driving the inking unit roller at the differential speed in a first operating state, and at the different differential speed in a second operating state, depending upon the ink content of the inking unit, which is different in the respective operating states.

In accordance with yet a further mode, the method of the invention includes driving the inking unit roller at the differential speed when the inking unit is running with ink, and driving the inking unit roller at the different differential speed when the inking unit is running virtually without ink.

In accordance with yet an added mode, the method of the invention includes changing-over the peripheral speed of the. inking unit roller in time-dependence upon an ink infeed into the inking unit.

In accordance with yet an additional mode, the method of the invention includes changing-over the peripheral speed of the inking unit roller in time-dependence upon a cleaning of the inking unit.

In accordance with a second aspect of the invention, there is provided a printing machine having a printing form cylinder and an inking unit for inking the cylinder, the inking unit comprising at least one inking unit roller drivable by a rotary drive at a differential speed with respect to the peripheral speed of the printing form cylinder, the rotary drive of the at least one inking unit roller being constructed so as to be changeable-over in time-dependence upon various operating states of the inking unit, so that the rotary drive drives the at least one inking unit roller at the differential speed in a first operating state, and drives the at least one inking unit roller at another relative speed in a second operating state.

In accordance with another feature of the invention, the printing machine includes an electronic control for Changing-over the rotary drive of the inking unit roller from the differential speed to the other relative speed and/or from the other relative speed to the differential speed, depending upon the quantity of ink in the inking unit during the operating states.

In accordance with a further feature of the invention, the electronic control device is linked controllingly with an infeed device for feeding printing ink to the inking unit, and serves for changing-over the rotary drive of the at least one inking unit roller in time-dependence for activating the infeed device.

In accordance with an added feature of the invention, the electronic control device is linked controllingly with a cleaning device for removing the printing ink from the inking unit, and serves for changing-over the rotary drive of the inking unit roller in time-dependence for activating the cleaning device.

In accordance with an additional feature of the invention, the rotary drive of the inking unit roller is an individual electric motor drive controllable independently of a rotary drive of the printing form cylinder.

In accordance with yet another feature of the invention, the other relative speed of the inking unit roller corresponds to the peripheral speed of at least one other roller of the printing machine.

In accordance with yet a further feature of the invention, the printing machine includes a rotary drive for driving the at least one other roller, the rotary drive of the at least one other roller being controllable independently of a rotary drive of the plate cylinder, and being an individual electric motor drive linked controllingly with the electronic control.

In accordance with yet an added feature of the invention, the rotary drive of the at least one other roller is Changeable-over in a manner coordinated with the rotary drive of the at least one inking unit roller.

In accordance with yet an additional feature of the invention, the at least one other roller is an inking unit roller of the inking unit.

In accordance with an alternative feature of the invention, the at least one other roller is a dampening unit roller of a dampening unit for dampening the printing form cylinder.

In accordance with a further alternative feature of the invention, the at least one other roller is a distributor roller oscillatable in the axial direction thereof.

In accordance with another alternative feature of the invention, the at least one inking unit roller is a distributor roller oscillatable in the axial direction thereof.

In accordance with a concomitant feature of the invention, the at least one inking unit roller and the at least one other roller are engageable simultaneously with one and the same roller.

Thus, the method according to the invention for operating a printing machine including a printing plate cylinder and an inking unit which inks the latter, at least one inking unit roller being driven in rotation at a differential speed with respect to the peripheral speed of the printing plate cylinder, is distinguished by the fact that the at least one inking unit roller is selectively driven at the differential speed and at a relative speed that is different from the peripheral speed of the printing plate cylinder, based upon the timing of various operating states of the inking unit.

Due to the driving of the one inking unit roller or the plurality of inking unit rollers, during the various operating states of the printing unit, at the tangential relative speeds which, as referred to the peripheral and tangential speed, respectively, of the printing form cylinder, are matched to the various operating states of the inking unit, a much greater service life of the soft rubber-covered rollers provided in the inking unit is achieved than in the operating methods according to the prior art.

For example, it is possible to drive the at least one inking unit roller or the several inking unit rollers at a peripheral speed which differs from the peripheral speed of the printing plate cylinder by a specific difference during a first operating state of the inking unit, and to drive it at a peripheral speed which differs from the peripheral speed of the printing plate cylinder by another difference during a second operating state of the inking unit. It is also possible to drive the one inking unit roller or the several inking unit rollers at a peripheral speed which differs from the peripheral speed of the printing plate cylinder in the first operating state of the inking unit and to drive it at a peripheral speed which is equal to the peripheral speed of the printing plate cylinder in the second operating state of the inking unit.

Managing the peripheral speed of the one inking unit roller or of the plurality of inking unit rollers in a manner coordinated with the operating states of the inking unit is therefore assured in the event of a change in the inking unit from the first to the second operating state, by increasing or reducing the relative speed in relation to the peripheral speed of the printing plate cylinder.

The action of changing-over or converting the inking unit from the first to the second operating state may require a transition state, which begins with the end of the first operating state and ends with the beginning of the second operating state.

For example, the first operating state may be such wherein the inking unit rollers of the inking unit rotate without infeeding ink thereto. As the printing ink is fed into the inking unit, the first operating state ends and the transition state begins, during which the inking unit is gradually filled with the printing ink. When the inking unit has been filled with the quantity of ink required for the inking of a printing form on the printing form cylinder, the transition state ends and the second operating state begins, the latter operating state being distinguished by a fully filled inking unit and by the fact that, during which, the printing plate is inked and can be used for printing. At the beginning, during or at the conclusion of the transition state, the action of Changing-over the peripheral speed of the one inking unit roller or of the plurality of inking unit rollers can be performed, so that coordination of the timing in relation to the following second operating state is provided.

If the inking unit is filled very quickly with the printing ink during the infeeding of the ink, and the inking unit roller to be changed-over, respectively, within an inking unit roller train, of which the inking unit is composed, is arranged very close to an infeeding device for feeding the printing ink to the printing unit, the action of changing-over the peripheral speed of the inking unit roller can be performed at the beginning of the transition state and, for example, simultaneously with a control signal which activates the infeeding device.

If the inking unit is filled only very slowly with the printing ink, and the inking unit roller to be changed-over, respectively, is located at a very great distance from the infeeding device, the action of changing-over the inking unit roller can be performed at the end of the transition state and, for example, simultaneously with a control signal which brings about the second operating state. This control signal can activate a dampening unit, which then pre-dampens the printing form and/or the inking unit. The control signal can also activate the inking unit, which then inks the printing form.

However, the transition of the inking unit from the first operating state to the second operating state can also be associated with emptying the ink from the inking unit. In this case, in the first operating state, the inking unit runs with a full supply of ink. The first operating state ends when cleaning of the inking unit begins, during which the printing ink in the inking unit is gradually removed from the inking unit during what constitutes the transition state. The end of the transition state, i.e., the conclusion of the cleaning of the inking unit, marks the beginning of the second operating state, during which the inking unit runs without having a supply of printing ink. The action of changing-over the inking unit roller or inking unit rollers can be performed at the beginning, during or at the conclusion of this transition state.

For example, in the case wherein a very small quantity of ink is present in the inking unit, and the inking unit roller to be changed-over in the inking unit roller train is arranged very close to the cleaning device, the action of changing-over the roller can be performed at the beginning of the transition state and at the same time as the mission of a control signal which activates the cleaning device.

In the event that there is a very large quantity of ink in the inking unit, the removal of the ink from the inking unit requiring a comparatively longer time, and in the case of an inking unit roller which is to be changed-over being placed far away from the cleaning device in the inking unit roller train, the action of changing-over the roller can be performed at the end of the transition state and, for example, at the same time as the issuance of a control signal which triggers a renewed input of ink following the cleaning of the inking unit.

The printing machine according to the invention, having a printing form cylinder and having an inking unit which inks the latter and which includes at least one inking unit roller drivable by a rotary drive at a differential speed with respect to the peripheral speed of the printing plate cylinder, is distinguished by the fact that the at least one rotary drive of the at least one inking unit roller is constructed so that it can be changed-over or shifted, based upon the timing of various operating states of the inking unit, so that the rotary drive drives the inking unit roller at the differential speed in a first operating state of the inking unit, and drives the inking unit roller at another relative speed in a second operating state of the inking unit.

The inking unit of a printing machine constructed in this way is subjected to considerably lower wear than is the case in printing machines constructed in accordance with the prior art. Because of the increased service life of soft-covered inking unit rollers, operational faults which occur between the regular maintenance intervals and are caused by any wear of these inking unit rollers are virtually ruled out during the operation of the printing machine. As a result of the increased long life of the inking unit, the printing machine is very easy to service. Because the soft-covered inking unit rollers no longer have to be replaced so frequently as a result of wear, reduced maintenance costs result.

The rotary drive can drive a number of inking unit rollers at the same time and can be constructed so that it can be Changed-over based upon the timing of the various operating states of the inking unit, so that the inking unit rollers rotate at the differential speed in a first operating state of the inking unit, and rotate at another relative speed in a second operating state of the inking unit.

The rotary drive can be a main electric motor drive of the printing machine, which also drives the printing form cylinder, and which drives the several inking unit rollers via a gear transmission mechanism. Each of the several inking unit rollers preferably has its own electric motor rotary drive assigned to it.

Both in the case of the varying embodiment of the drive or so-called drive variants having a rotary drive which can be changed-over for a number of inking unit rollers, and in the case of the drive variant having a number of inking unit rollers, respectively, driven by a rotary drive which can be changed-over, it is possible for the inking unit rollers to rotate with different, stepped differential speeds in the first operating state.

The advantage of the inking unit which includes a number of inking unit rollers, which are driven at the differential speed by the one rotary drive or the number of rotary drives in the first operating state, and are driven at the other relative speed in the second operating state, is that the printing ink processed in the inking unit is not only rolled but is also crushed in the peripheral direction of the inking unit rollers. As a result, a detrimental surface structure of the film of printing ink, the so-called orange-peel structure, is avoided in the first operating state; this structure could occur if the inking unit rollers were to roll on one another and on the printing plate cylinder at the same peripheral speed.

If the first operating state of the inking unit represents the inking of the printing form, or printing by using the printing form, a considerably higher print quality is achieved by the aforedescribed construction of the inking unit. Tests or trials have shown that if the inking unit rollers roll at a peripheral speed ratio of 1:1 in relation to one another, this is inadequate in many cases to ink an area or half-tone points homogeneously. By using a number, i.e., a plurality, of inking unit rollers in the inking unit being driven formlockingly or positively and with slippage in relation to the rollers adjacent thereto, smoother inking is possible, this improvement making itself noticeable in particular in short or anilox inking units in a comparatively low number of ink applicator rollers inking the printing form.

Such a short or anilox inking unit is described, for example, in the published German Patent Document DE 42 30 090 C2, the first and second ink applicator rollers of a total of four existing ink applicator rollers being employed for inking in the short or anilox inking unit operating mode, and the third and fourth ink applicator rollers being thrown off the printing form.

If the printing machine is an offset printing machine, and a dampening unit for dampening the printing plate is associated with the inking unit, a particularly stable printing ink/dampening solution emulsion is achieved by the large number of inking unit rollers rotating at the differential speed in the first operating state, the dampening solution being worked even better into the printing ink and into the print-free points on the printing form.

The fact that the several inking unit rollers which can be changed-over, respectively, have their own electric motor rotary drive provides a particularly beneficial possibility of driving and adjusting the rotary drives independently of one another in terms of the speed thereof.

The printing machine according to the invention permits the method according to the invention to be performed, and permits the advantages particular to the method to be realized.

The printing machine is preferably constructed as a rotary offset printing machine.

Other features which are considered as characteristic for the invention are set forth in the appended claims.

Although the invention is illustrated and described herein as embodied in a method of operating a printing machine, and a printing machine for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
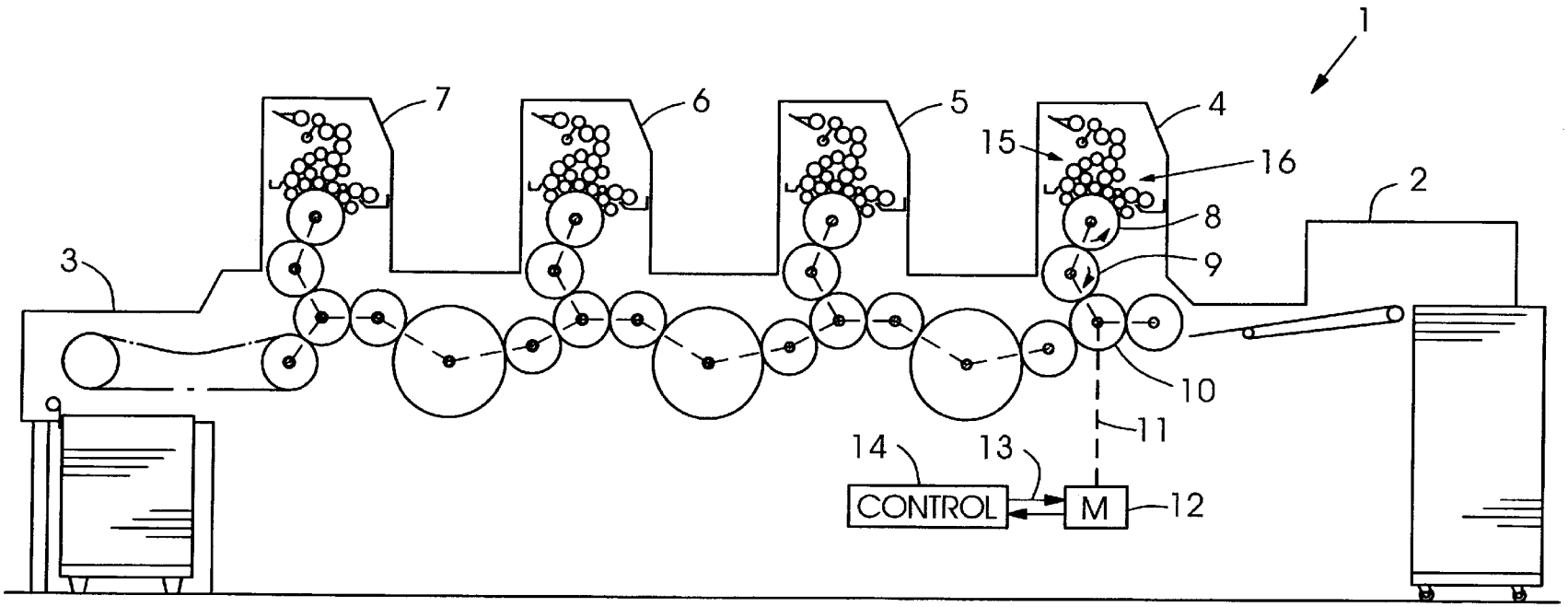
FIG. 1 is a diagrammatic side elevational view of a rotary printing machine optionally having four offset printing units.

Referring now to the drawings and, first, particularly to FIG. 1 thereof, there is shown therein a rotary printing machine 1 having a sheet feeder 2, a sheet delivery 3 and several, namely four, offset printing units 4 to 7 in this embodiment. Each printing unit 4 to 7 is of identical construction and includes a printing form cylinder 8 and a blanket cylinder 9, which transfers the printing ink from the printing form cylinder 8 to the printing material and, in so doing, rests on an impression cylinder 10. The printing form cylinder 8 has an inking unit 15 assigned thereto for inking and a dampening unit 16 for dampening a planographic printing form or plate clamped onto the printing form cylinder 8. The printing unit cylinders 8 to 10 are rotatingly driven, via a transmission mechanism 11 represented diagrammatically with broken lines, by a main drive 12 of the printing machine 1. The mechanism 11 also includes mutually meshing gears on shafts of the cylinders 8 to 10. The drive 12 is an electric motor that jointly drives all the printing units 4 to 7. For this purpose, the printing units 4 to 7 are likewise coupled to one another via the transmission mechanism 11. The drive 12 is driven by a programmable electronic control device 14 via electric control lines 13.

Figure 2:
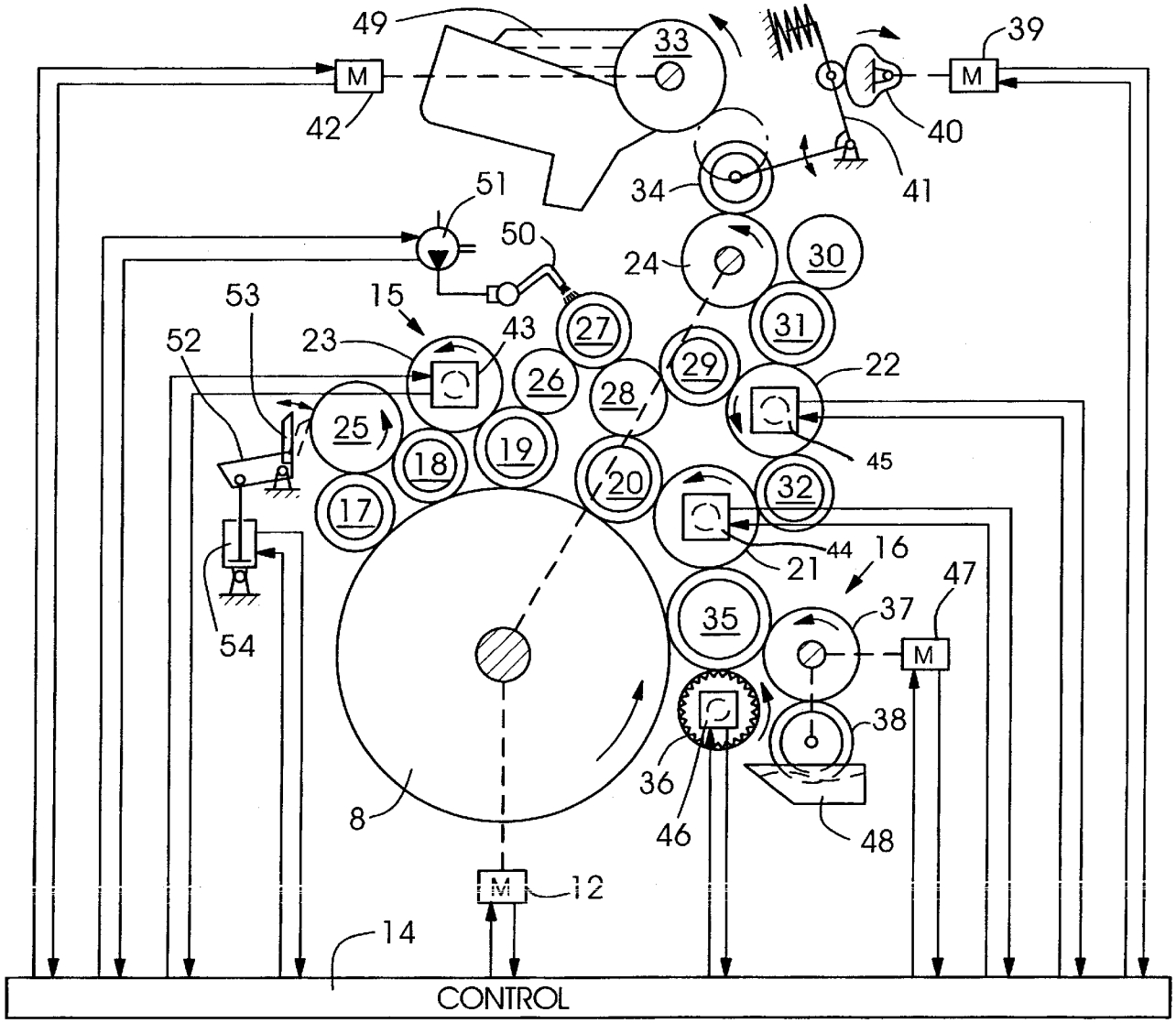
FIG. 2 is an enlarged fragmentary view of FIG. 1 showing diagrammatically and schematically an inking unit and a dampening unit of one of the offset printing units, as well as an electronic control device for controlling the inking unit and the dampening unit.

FIG. 2 illustrates part of the printing unit 4 in detail. The inking unit 15 includes ink applicator rollers 17 to 20 engaging the printing form cylinder 8, ink transfer rollers 21 to 29, a so-called rider roller 30 engaging only a single further roller, a wedge-shaped ink fountain 49 having an associated ink fountain roller 33, and a vibrator roller 34 that picks up the printing ink from the roller 33 and passes it onto the roller 24. The rollers 33 and 34, together with the ink fountain 49, form an ink feeding device 33, 34 and 49 which feeds printing ink to the inking unit 15. The roller 33 is rotatingly driven by an ink fountain roller drive 42, and the oscillating reciprocatory movement of the roller 34 between the rollers 33 and 24 is effected by a vibrator roller drive 39. The drive 39 causes the oscillation of the roller 34 via a cam mechanism 40, 41, the drive 39 rotating a cam disk 40 which thereby pivots a spring-loaded roller lever bearing the roller 34. The drives 39 and 42 are electric motors and are driven by the control device 14 in a manner coordinated with one another and with the drive 12.

The dampening unit 16 includes a dampening solution applicator roller 35 which is in contact with the printing form cylinder 8 and with which the dampening unit roller 36 engages as a so-called rider roller. The rollers 30 and 36, respectively, are in contact with only a single roller, and are therefore not transfer rollers which are in contact with at least two and often several rollers. A metering roller 37, which picks up dampening solution from a dip or pan roller 38 and passes it onto the roller 35, is rotatively driven by a dampening unit drive 47 which is in the form of an electric motor and is driven by the control device 14 in a manner coordinated with the drives 12, 39 and 42. The formlockingly or positively driven rollers 37 and 38 have a mutual drive connection via intermeshing gears which are seated on the shafts of the rollers 37 and 38, so that the roller 38 can likewise be driven by the drive 47. The rollers 21 to 24 are ink distributor rollers which oscillate in the axial direction thereof, and the roller 36 is a dampening solution distributor roller which oscillates in the axial direction thereof. The oscillating movement of each of the rollers 21 to 24 and 36 is imparted thereto by a respective oscillating mechanism in a manner coordinated with the rotation of the printing form or plate cylinder 8.

The inking unit rollers 21 to 24 and the dampening unit roller 36 are rollers which are driven formlockingly or positively by rotary drives 12, 43 to 46, whereas, in contrast therewith, the rollers 17 to 20, 25 to 32, 34 and 35 are frictionally driven rollers which are rotatively driven by one or more of the formlockingly or positively driven rollers 21 to 24 and 36 and to some extent by the printing form or plate cylinder 8.

Some of the frictionally driven rollers are driven by the printing form or plate cylinder 8 or by one of the formlockingly or positively driven rollers by direct frictional entrainment. This applies, for example, to the roller 35, which is driven by frictional entrainment by the roller 36 that is provided with a rough chrome-plated surface in order to increase the friction. Other frictionally driven rollers are driven by one of the aforementioned formlockingly or positively driven rollers via a likewise frictionally driven intermediate roller or via a plurality of intermediate rollers. For example, the roller 26 is driven frictionally via the roller 19, to some extent by the printing form or plate cylinder 8 and to some extent by the roller 19, and, in turn, frictionally drives the roller 27 which is in contact with the roller 26.

The rollers 17 to 20, 27, 29, 31, 32, 35 and 38 are comparatively soft and, for example, are covered with a rubber-covered resilient peripheral layer. The rollers 21 to 26, 28, 30, 33, 36 and 37 are comparatively hard at the respective periphery thereof and, for example, are steel rollers or are rollers coated with a hard plastic layer (such as, for example, the plastic material known by the trade name Rilsan). The inking unit 15 can be connected to the dampening unit 16 via the roller 21, so that the printing form on the printing form cylinder 8 can be dampened indirectly via the ink applicator roller 20. The roller 24 is driven by the drive 12 via a gear mechanism represented diagrammatically by a broken line.

According to a preferred alternative drive illustrated in FIG. 2, the rollers 21 to 23 and 36, respectively, have assigned thereto their own individual drive 43 to 46 in the form of an electric motor for the purpose of rotating the respective rollers 21 to 23 and 36. The rotational speed of the drives 43 to 46 are regulatable, respectively, independently of one another and independently of the drive 12. For this purpose, for each of the drives 43 to 46, the same peripheral speed or stepwise, respectively, a further peripheral speed that is different from and preferably lower than the peripheral speed of the printing form cylinder 8, i.e., than the peripheral speed of the printing form resting on the cylinder, (differential speed), for example, in the form of percentages referred to the peripheral speed of the printing form cylinder 8, can be input or preferably programmed. The drives 43 to 46 are changeable-over or convertible from a "differential speed" operating mode to a "synchronous speed" operating mode and in reverse. In the "synchronous speed" operating mode, the rollers 21 to 23 and 36 rotate at the same peripheral speed as the printing plate cylinder 8. The action of converting the drives 43 to 46 can be initiated by the pressman by suitably pressing a knob or pushbutton on the control device 14, or preferably automatically by a control program released in the control device 14. In addition, in the event of an increase or decrease in the printing speed driven by the drive 12 and for each drive 43 to 46, the control device 14 tracks the drives 43 to 46 so that they follow the drive 12 in the respectively corresponding direction of change in the printing speed.

A second though non-illustrated drive embodiment differs from the aforedescribed first drive embodiment in that two or more of the rollers 21 to 23 are rotationally coupled via a gear mechanism and are driven by a single common rotary drive formed as an electric motor and can be controlled independently of the main drive 12.

According to a third and also non-illustrated drive embodiment, the rotation of the rollers 21 to 23 and 36 is effected by the drive 12 via a change-speed or switch gear mechanism formed, for example, as a variable-ratio gear transmission mechanism. This gear transmission mechanism is selectively adjustable by being mechanically switched alternatively into a "differential speed" switching position and a "synchronous speed" switching position. An actuator, for example, a pneumatic cylinder, that effects this adjustment of the gear transmission mechanism, is controlled by the control device 14 by push-button or preferably in accordance with a program. In the case of the third drive embodiment, the rollers 21 to 23 and 36 rotate at a peripheral speed that is equal to the peripheral speed of the printing form cylinder 8 in the "synchronous speed" switching position, and at a different and preferably lower peripheral speed than that of the printing form cylinder 8 in the "differential speed" switching position.

Of course, combinations of the first and second with the third drive embodiments are possible. For example, in a preferred combination, the rotation of the rollers 21 to 23 is convertible or changeable-over to accord with the first drive embodiment, and the rotation of the roller 36 is convertible or changeable-over to accord with the second drive embodiment. In the case of the three drive embodiments, it is also possible for a "different differential speed" operating mode to occur instead of the "synchronous speed" operating mode, and for the "different differential speed" switching position to occur instead of the "synchronous speed" switching position.

The different differential speed with respect to the peripheral speed of the printing form cylinder is understood to mean that one or more of the rollers 21 to 23 and 36 are driven by the respective rotary drive thereof at the differential speed with respect to the peripheral speed of the printing form cylinder 8 in a first operating state of the inking unit and, in a second operating state of the inking unit, are driven by the respective rotary drive thereof at a differential speed that is increased or reduced in comparison with that of the first operating state.

For the purpose of cleaning the inking unit 15, the latter has a cleaning device 50 to 54 assigned thereto, which is controlled by the control device 14. The cleaning device 50 to 54 includes a strip-shaped doctor blade 53 that is pressable against the roller 25 and is fastened to a collecting trough 52 to collect therein the printing ink doctored or squeezed off the roller 25. The doctor blade 53 is pressable against and liftable off the roller 25 by a doctor-blade adjusting drive 54 that is formed, for example, as a pneumatic operating cylinder and pivots the collecting trough 52. Furthermore, the cleaning device 50 to 54 includes a washing fluid feed 50, 51, which includes a pump 51 and a spray tube 50. The pump 51 pumps the washing fluid into the spray tube 50, which discharges the washing fluid through spray nozzles onto the roller 27. The control device 14 controls the pump 51 and the doctor-blade adjusting drive 54 so that they are mutually coordinated, with the result that the action of pressing the doctor blade 53 against the roller 25 and expelling the washing fluid from the spray tube 50 is performed with coordinated timing and, for example, after feeding washing fluid into the inking unit 15, a given washing-fluid residence time elapses before the doctor-blade adjusting drive 54 is activated in order to bring the doctor blade 53 into contact with the roller 25.

Hereinafter, the example of the first drive embodiment illustrated in FIG. 2, wherein the individual electric motor drives 43 to 46 are used, serves to illustrate the specific construction in control terms of the printing machine 1 and a method for converting the differential speed/synchronous speed of the rotation of at least one inking unit roller 21 to 23, and, for example, several inking unit rollers 21 to 23, and preferably a combination of several inking unit rollers 21 to 23 and a dampening unit roller 36 with coordinated timing in order to activate the ink feeding device 33, 34 and 49 and/or with coordinated timing in order to activate the cleaning device 50 to 54.

This example is readily transferrable to a differential speed/different differential speed conversion or change-over of the rotation of the foregoing rollers. The method can also be performed readily with an otherwise not specifically illustrated printing machine, the nonconvertible rollers 21 to 23 and 36 of which are driven in accordance with the third drive embodiment, the change-gear mechanism mentioned hereinbefore functioning as the rotary drive that is controllable by the control device 14, instead of the individual electric motor drives 43 to 46, and accordingly being linked to the control device 14. It is of course also possible for the method of the invention to be performed with a printing machine formed in accordance with the second drive embodiment.

If the pressman triggers the "ink infeed" control signal by pressing a pushbutton on the control device 14, or if this control signal is triggered by a program released in the control device 14, the vibrator roller drive 39 is activated. The vibrator roller 34 is thereby moved alternatingly towards the ink fountain roller 33 rotated by the ink-fountain roller drive 42 and towards the inking unit roller 24 rotated by the drive 12, with intermittent contact with these rollers 24 and 33, so that the printing ink conveyed from the ink fountain 49 by the ink fountain roller 33 is transferred to the inking unit roller 24 by the vibrator roller 34.

Simultaneously with the "ink infeed" control signal, the control device 14 checks to determine whether the drives 43 to 45, which are formed as individual electric motor drives, are driving the inking unit rollers 21 to 23, which are formed as distributor rollers, at the synchronous speed corresponding to the peripheral speed of the printing form cylinder 8. Each inking unit roller 21 to 23 which is not being rotatively driven at this synchronous speed is immediately changed-over or converted to the synchronous speed by an appropriate programmed control signal from the control device 14. The inking unit roller 24 likewise formed as a distributor roller, is always driven at the synchronous speed, due to the construction thereof, via a gear transmission mechanism, by the drive 12, which is the main electric motor drive of the printing machine 1 and which also rotatively drives the printing form cylinder 8.

At this instant, the rollers 17 to 20 and 35 are not yet in peripheral contact with the printing form cylinder 8. The inking unit rollers 17 to 20, 27, 29, 31 and 32, which are covered with soft rubber, are not subjected to any abrasive wear due to adjacent rollers making contact with these rollers, even if no printing ink whatsoever or insufficient printing ink has yet reached the circumferential outer surface of the rollers 17 to 20, 27, 29, 31 and 32. For example, the drive 44 driving the roller 32 due to the entrainment of the latter by friction via the roller 21, and the drive 45 likewise driving the roller 32 due to the entrainment of the latter by friction via the roller 22 do not represent mutually competitive drives 44 and 45, so that the roller 32 can be driven frictionally by the rollers 21 and 22 virtually without any significant slip within the contact points with the latter. The abrasion of rubber during that time interval wherein the roller 32 remains not yet covered by a film of printing ink for protecting it adequately against abrasion is thus reliably prevented. This applies as well, for example, to the roller 27, to which a sufficient quantity of printing ink has not yet been transported at the beginning of the infeed of ink, and which is driven frictionally by the rollers 26 and 28. The roller 26 is, in turn, driven frictionally by the roller 19, the latter being driven frictionally by the formlockingly or positively driven roller 23. The roller 28 is driven frictionally by the rollers 20 and 29, which are, in turn, driven frictionally by the formlockingly or positively driven rollers 21 and 22. During the ink infeed phase, the drive 43 therefore does not constitute a drive that competes with the drives 44 and 45, which permits the roller 27 to be braked or accelerated in relation to the drive of the roller 27 by the drives 44 and 45. During the infeed of ink, all of the inking unit rollers 17 to 32 therefore rotate at the same peripheral speed which, in the synchronous speed example, corresponds to the peripheral speed of the printing form cylinder 8.

After a given time interval, all the inking unit rollers 17 to 24 are covered by the layer of ink that is required to ink the printing form on the printing form cylinder 8, the lubricating action of the ink layer virtually ruling out any abrasion of the soft rollers covered with rubber due to the hard steel rollers which are in contact with the soft rollers. If the inking of the printing form cylinder 8 is envisaged with the ink applicator rollers 17 to 20 rotating at a differential speed differing from the peripheral speed of the cylinder 8, the drives 43, 44 and 45 can be converted from the synchronous speed to the differential speed, by the control device 14, at the end of the infeed of ink. In this case, the pressman issues the command to ink by pressing a pushbutton on the control device 14, after which the ink applicator rollers 17 to 20 are moved by a not otherwise specifically illustrated actuating device from a thrown-off position into a position wherein they are thrown onto the printing form cylinder 8.

Simultaneously, as the control signal that causes the actuating device to throw the ink applicator rollers 17 to 20 onto the printing form cylinder 8, the control device 14 sends a "differential speed" control signal to the drives 43 to 45. However, provision may also be made for the inking of the printing form cylinder 8 to be performed with the drives 43 to 45 still operating at the synchronous speed, and consequently with the ink applicator rollers 17 to 20 rolling without slippage on the printing form cylinder 8. In the last-mentioned case, it is possible, for example, for the action of converting or changing-over the drives 43 to 45 from the synchronous speed to the differential speed to be performed simultaneously using a "printing on" control signal, with which the blanket cylinder 9 is thrown initially onto the printing form cylinder 8 and then onto the impression cylinder 10.

In all of the herein aforedescribed cases, the formlockingly or positively driven inking unit rollers 21 to 23 rotate at the synchronous speed before and during the infeeding of ink, and at the differential speed after the infeed of the ink. If the printing form on the printing form cylinder 8 is not a dry offset printing form but rather a wet offset printing form which, in order to print, must be dampened with dampening solution in the dampening solution container 48, it is possible for dampening of the printing form and so-called pre-dampening of the inking unit 15 to be performed before the printing form is inked, i.e., before the ink applicator rollers 17 to 20 are thrown onto the printing form cylinder 8.

For the purpose of pre-dampening the inking unit 15, a contact is formed between the dampening unit roller 35 and the inking unit roller 21, for example, by the roller 35 being thrown from a position spaced from the roller 21 into a position wherein it is in contact with the roller 21. The dampening unit roller 38 is a dip roller that scoops the dampening solution out of the dampening solution container 48 and with which the dampening unit roller 37, formed as a metering roller, makes contact. Both rollers 37 and 38 are driven by the dampening unit drive 47, formed as an electric motor, at a peripheral speed significantly lower than the peripheral speed of the roller 35. This applies both to the operating state wherein the roller 35 rotates at a speed synchronous in relation to the peripheral speed of the printing form cylinder 8, and to the-operating state wherein the roller 35 rotates as a peripheral speed different in relation to the peripheral speed of the printing form cylinder 8.

Of course, the drive 47 is speed-compensated in exactly the same way as the drives 43 to 46, i.e., the drive 47 is entrained by the control device 14 so as to coordinate with the drive 12 in the event of a change in the printing speed and the rotational speed, respectively, of the printing form cylinder 8. The rollers 37 and 38 are rotationally coupled with one another via a gear transmission mechanism, and the roller 37 transfers the dampening solution in a metered manner to the roller 35. The drive 46, which drives the roller 36 formlockingly or positively and is formed as the individual electric motor drive thereof, drives the roller 35 due to the entrainment of the roller 35 by friction via the roller 36. The position, shown in FIG. 2, wherein the inking unit 15 is connected to the dampening unit 16 is used not only for the pre-dampening of the inking unit 15 but also for the additional indirect dampening by the ink applicator roller 20 for the purpose of the direct dampening of the printing form cylinder 8 by the dampening solution applicator roller 35.

Both in the case of the pre-dampening of the inking unit 15 and in the case of the indirect dampening of the printing form cylinder 8, wear of the rubber-covered, soft roller 35 is avoided by having the drives 44 and 46 controlled by the control device 14 in a manner that the peripheral speeds of the rollers 21 and 36 are coordinated with one another in terms of magnitude and are preferably equal, so that any slippage between the roller 21 and the roller 35 and also between the roller 36 and the roller 35 is avoided, and the drives 44 and 46 are not competitive drives. This is therefore particularly important because the roller 36, which is exclusively in contact with the roller 35, is kept pressed comparatively firmly against the roller 35, and has a circumferential surface that is rough and provided, for example, with microscopic spherical segments or is mat chromium-plated, the roughness peaks of the surface, for the purpose of driving the roller 35 frictionally, being buried comparatively deeply in the soft circumferential surface of the latter, so that reliable entrainment of the roller 35 is provided at the point of contact between the rollers 35 and 36. In contrast therewith, the friction between the roller 35 and the roller 37, that has a relatively smooth periphery and rotates slowly, is much lower, so that the rotation of the roller 35 is virtually uninfluenced by the drive 47.

If the rollers 21 and 35 are connected by an otherwise non-illustrated actuating device controlled by the control device 14, the control device 14 always controls the drive 46 and the roller 36 precisely at the speed which is synchronous with the peripheral speed of the printing form cylinder 8 when the roller 21 is also driven at the synchronous speed by the drive 44. If the control device 14 controls the drive 44 and the roller 21 at the differential speed relative to the peripheral speed of the printing form cylinder, the drive 46 is also driven in the same way, so that the roller 36 also rotates at a differential speed which is coordinated with the differential speed of the roller 21 and preferably corresponds thereto. The driving of the drives 44 and 46 which is effected by the control device 14 makes it possible in this way to ensure that the rollers 21 and 36 will always rotate at a mutually identical peripheral speed.

At this juncture, reference should be made again to the fact that it is also possible to drive the roller 36 from the drive 12 via a change-speed or switch gear mechanism controlled by the control device 14, the control device 14 placing the change-speed or switch gear mechanism into a "synchronous drive" switching position when the drive 44 drives the roller 21 at the synchronous speed, and placing the change-speed or switch gear mechanism into a "differential speed" switching position when the drive 44 rotates the roller 21 at the differential speed.

When printing is being performed with the printing form cylinder 8 and rollers 17 to 20 in contact therewith, the rollers 21 to 23, respectively, rotate with a differential speed relative to the peripheral speed of the printing form cylinder 8, it being possible for the differential speeds of the rollers 21 to 23 to be stepped relative to one another and, for example, for the difference between the peripheral speed of the roller 22 and the peripheral speed of the printing form cylinder 8 to be greater, and the difference between the peripheral speed of the roller 23 and the peripheral speed of the printing form cylinder 8 to be smaller than the difference between the peripheral speed of the roller 21 and the peripheral speed of the printing form cylinder 8.

If printing is performed in the wet offset process, using the dampening unit 16, during the printing, the roller 36 rotates at the peripheral speed of the roller 21, so that the roller 35 is not subjected to any significant abrasion by any of the three rollers 21, 36 and 37 in contact therewith.

It is possible to operate the inking unit 15 as a so-called short or anilox inking unit, only some of the ink applicator rollers 17 to 20 which are present overall being used for inking the printing form cylinder 8, in this operating mode. In a first modification of the short or anilox inking unit operating mode, this can be, for example, the first ink applicator roller 20 inking the printing form cylinder 8 as referred to the direction of rotation of the latter and, together with the ink applicator roller 20, the second ink applicator roller 19. The third ink applicator roller 18 and the fourth ink applicator roller, 17 are thrown off the printing form cylinder 8 in the short or anilox inking unit operating mode. In the case of the first modified embodiment of the short or anilox inking unit, for example, the roller 23 is out of contact with the roller 19, and the rollers 17, 18, 23 and 25 are not supplied with the printing ink, but the roller 19 is supplied with printing ink via the roller 27 which is in contact with the rollers 26 and 28.

In a second modification, it is possible for the roller 20 to make contact with the printing form cylinder 8, as a single ink applicator roller, in the short or anilox inking unit operating mode. The dampening solution applicator roller 35, via which a dampening solution/printing ink emulsion is also applied to the printing form cylinder 8 in the short or anilox inking unit operating mode, is not an ink applicator roller in the actual sense. The ink applicator rollers 17, 18 and 19 are thrown off the printing form cylinder 8 in the second modification of the short or anilox inking unit. The roller 27 is thrown off the roller 26 and/or the roller 28, so that the inking unit part 17 to 19, 23, 25 and 26 which trails in the direction of rotation of the printing form cylinder 8 is not supplied with the printing ink from the ink fountain 49.

In the two aforedescribed modified embodiments of a short or anilox inking unit, with the effective employment of a single ink applicator roller 20 or no more than two applicator rollers 19 and 20 and, if appropriate, of a dampening solution applicator roller 35 in addition to this single ink applicator roller 20 or these two ink applicator rollers 19 and 20, it is necessary to prepare the printing ink in a manner which is particularly well suited to the printing.

The ink applicator rollers 17 and 18 which are inactive in the short or anilox inking unit operation according to the first modification, and the ink applicator rollers 17, 18 and 19 which are inactive according to the second modification are no longer able to contribute to making the printing ink already applied to the printing plate more uniform, as in normal inking unit operation. Nor can the inking unit roller 23, that is formed as a distributor roller, contribute any more to mechanical preparation of the printing ink in the inking unit in the short or anilox inking unit operation. For this reason, in the inking unit 15 that is shown in FIG. 2 and can be operated in short or anilox inking unit operation, it is particularly beneficial that the inking unit, having the inking unit rollers 21 and 22 formed as distributor rollers, has a number of positively driven inking unit rollers which, in short or anilox inking unit operation, rotate at a peripheral speed that differs from the peripheral speed of the printing form cylinder 8 and possibly also at peripheral speeds which are different from one another. These rollers 21 and 22 are part of a roller train used for short or anilox inking unit operation, and the transport of ink from the ink feeding device 49 to the single ink applicator roller 20 (second modified embodiment) which is active in short or anilox inking unit operation, or the two ink applicator rollers 19 and 20 (first modified embodiment) which are solely active in short or anilox inking unit operation, is performed via these rollers 21 and 22.

For example, in short or anilox inking unit operation, the rollers 21, 22 and 24 can be driven formlockingly or positively at mutually different peripheral speeds, it being possible for the peripheral speed of the roller 21 to correspond to the peripheral speed of the printing form cylinder 8. The drives 44 and 45 thus constitute drives which are competitive with the drive 12 and with one another. The result is, for example, slippage between the roller 22 and the roller 32 and slippage between the roller 21 and the roller 32. The result is also slippage between the roller 22 and the roller 29 and between the roller.28 and the roller 29. Slippage likewise results between the printing form cylinder 8 and the roller 20 and between the roller 20 and the roller 28. In practice, with the exception of the roller 30 that is exclusively in contact with the roller 31, slippage occurs between all of the inking unit rollers making the printing ink ready in short or anilox inking unit operation in relation to the rollers adjacent thereto or, in the case of the ink applicator rollers 19 and 20, also in relation to the printing form cylinder 8.

In this manner, for a comparatively low overall number of inking unit rollers, it is possible to achieve effective distribution of the printing ink in the peripheral direction in addition to the distribution in the axial direction of the printing ink in the inking unit 15, so that, in short or anilox inking unit operation, according to the second modified embodiment, the printing ink is applied to the printing form by the roller 20 and, according to the first modified embodiment, the printing ink is applied to the printing form by the rollers 19 and 20 with virtually identical quality, such as is also provided if more than two and, for example, all the ink applicator rollers 17 to 20 which are present are used.

In the short or anilox inking unit operating mode of the inking unit 15, the dampening unit 16 is used in the same manner and is driven by the drives 46 and 47 and, if necessary, by the drive 12, as has already been described in that part of the description which refers to operating the inking unit as a normal inking unit.

Of course, the drives 44 to 46 are also converted or changed-over with coordinated timing in relation to the infeed of ink in short or anilox inking unit operation. It is also possible for the action, yet to be described hereinbelow, of converting or of changing-over the drives 43 to 45 with coordinated timing for the purpose of cleaning the inking unit to be readily transferred to a short or anilox inking unit having only one ink applicator roller 20 or having two applicator rollers 19 and 20. For example, for this purpose, the inking unit roller 22 belonging to the short or anilox inking unit can have a cleaning device assigned thereto that is comparable with the cleaning device 52 to 54, and the short or anilox inking unit can have a cleaning fluid infeed assigned thereto that is comparable with the cleaning fluid infeed 50, which sprays the cleaning fluid onto the roller 31, for example. For these reasons, a single description using the example of the normal inking unit operation illustrated in FIG. 2 is sufficient, and it is not necessary to go into detail again in relation to controlling the drives 44 to 46 by the control device 14 during the cleaning of the short or anilox inking unit.

During the printing of large jobs, in the case of a print job following the current print job and using a different printing ink to be fed into the ink fountain 49, and at the end of a shift, a respective cleaning of the inking unit 15 is required. For example, in accordance with the respective program being executed in the control device 14, a "cleaning" to control signal is triggered after a given number of prints have been printed since the last cleaning of the inking unit 15. The pressman is also able to trigger such a control signal by pressing a pushbutton on the control device 14 as required and, for example, at the end of a shift.

Simultaneously with the triggering of the "cleaning" control signal, the drive 39 and, if appropriate, the drive 42 are brought to a standstill by a further control signal, so that the ink infeed into the inking unit 15 is interrupted. The cleaning fluid infeed 50, 51 is likewise activated at the same time as the "cleaning" control signal, by the pump 51 being switched on by the control device 14, so that the pump 51 pumps the cleaning fluid into the spray tube 50, from which the cleaning fluid is applied into the inking unit 15 and onto the roller 27 within a given time interval or in a number of spraying surges. Following a programmed residence time, for which the control device 14 waits, the control device 14 throws the strip-shaped doctor blade 53 onto the roller 25, by the control device 14 outputting the "throw doctor blade on" control signal to the doctor-blade adjusting drive 54. The doctor-blade adjusting drive 54 is a pneumatic operating cylinder, to which compressed air is then applied, so that the doctor-blade adjusting drive 54 pivots the doctor blade 53, together with the collecting trough 52 bearing the latter, against the rotating roller 25. From the roller 25, the printing-ink/cleaning-solution mixture located on the roller 25 flows over the back of the doctor blade 53 into the collecting trough 52. The printing ink located on the inking unit rollers 17 to 32 and 34, which are in contact with one another, gradually flows towards the roller 25 and is scraped off the latter by the doctor blade 53.

In this regard, it is possible for the control device 14 to control the cleaning device 50 to 54 in accordance with washing cycles which have already been programmed in the control device 14 or which are freely programmable therein by the pressman, so that the repeated infeeding of cleaning fluid by the cleaning fluid feeding device 50, 51 is performed at given time intervals. If the connection between the inking unit 15 and the dampening unit 16 via the rollers 21 and 35 is maintained, the entire dampening unit 16 or parts of the dampening unit 16 can be washed together with the inking unit, 15. In this case, in order to avoid any contamination of the dampening solution in the dampening solution container 48, it is possible, for example, for the trough-like dampening solution container 48 to be lowered, so that the roller 38 no longer dips into the dampening solution in the dampening solution container 48. Separation of the contact between the rollers 35 and 37 is also possible.

For example, in the case of cleaning after a print job has 140 been completed, it is also expedient to clean the printing form on the printing form cylinder 8 before it is removed from the printing form cylinder 8. Therefore, in this case, the ink applicator rollers 17 to 20 are kept in contact with the printing form cylinder 8 by the non-illustrated actuating device during the cleaning of the inking unit. The cleaning of the printing form on the rotating, printing form cylinder 8 thus also takes place at the same time as the cleaning of the inking unit 15 by the cleaning device 50 to 54.

During the course of the cleaning, the inking unit 15 becomes cleaner and cleaner, so that the layer of printing ink on the soft inking unit rollers 17 to 20, 27, 29, 31 and 32 is diluted more and more by the supplied cleaning fluid, and the cleaning fluid/printing ink mixture becomes less and less as a result of being doctored off. Beginning at a given instant of time during the cleaning, the printing ink in the inking unit 15, or the cleaning fluid/printing ink mixture in the inking unit 15 is no longer adequate to prevent any slippage-induced wear of the soft inking unit rollers 17 to 20, 27, 29, 31 and 32. This critical instant is in any case reached after the cleaning of the inking unit 15 has been completed and, if appropriate, after the cleaning of the printing form cylinder 8 cleaned at the same time via the inking unit 15.

If the drive 43 were then to drive the roller 23 at a peripheral speed that differs from the peripheral speed of the printing form cylinder, a risk would arise that the soft rollers 18 and 19, running blind or stripped between the roller 23 and the printing form cylinder 8, would be ground down. Assuming that, at the critical instant, the drives 44 and 45 drive the rollers 21 and 22 at speeds which are different from one another, the roller 32 running stripped between the rollers 21 and 22 would be ground down. It is therefore advantageous to take care, from a control standpoint, that, beginning from the critical instant, the drives 43 to 45 drive the rollers 21 to 23 at peripheral speeds which are identical to one another. In the event that the printing form cylinder 8 is washed at the same time as the inking unit 15, it is advantageous for the rollers 21 to 23 and 36 not only to rotate at a synchronous peripheral speed in relation to one another but also to rotate at a synchronous speed in relation to the peripheral speed of the printing form cylinder 8, so that, for example, the roller 35 is not crushed between the rollers 21 and 36 on one side and the printing form cylinder 8 on the other side.

In the situation wherein the dampening unit roller 35 is washed at the same time as the inking unit 15, via the roller 21 which is in contact therewith for that purpose, it is advantageous for the drive 46 to be controlled by the control device 14 as well, beginning at the critical instant, in such a manner that the drive 46 continues to drive the rollers 35 and 36 at a peripheral speed equal to that of the roller 21.

At the same time that the "cleaning" control signal is output to the cleaning device 50 to 54, the drives 43 to 45 are converted or changed-over so as to bring the rollers 21 to 23 into synchronism with one another. If this necessitates a change in the speed of the drive 44, the drive 46 is tracked appropriately by the control device 14, so that the synchronism between the rollers 21 and 36 is maintained.

However, the rollers 21 to 23 and 36 rotating synchronously with one another can rotate at a common peripheral speed which is different than the peripheral speed of the printing form cylinder 8 if the printing form cylinder 8 is not washed at the same time as the inking unit 15, and therefore has no contact with any of the rollers 17 to 20 and 35.

The control signals having the effect of converting or Changing-over the drives 43 to 46 for the purpose of synchronizing them with one another and, if necessary, with the drive 12, can also be triggered at the critical instant by the control device 14, for example, by using sensors to monitor the ink content of the inking unit 15. It is also possible for these control signals to be triggered by the control device 14 with a programmed and empirically determined time offset following the triggering of the "cleaning" control signal. If the roller 36 is not driven by the illustrated direct electromotive drive 46 but by the drive 12 via the change-speed or switch gear mechanism which has already been described but not illustrated, the control device 14 controls the switch gear mechanism in the manner described in relation to driving the direct electromotive drive 46 during the cleaning operation.

We claim:

1. A printing machine having a printing form cylinder and an inking unit for inking the cylinder, the inking unit comprising at least one inking unit roller drivable by a rotary drive at a differential speed with respect to the peripheral speed of the printing form cylinder, said rotary drive of said at least one inking unit roller being constructed so as to be changeable over in time-dependence upon various operating states of the inking unit, so that said rotary drive drives said at least one inking unit roller at the differential speed in a first operating state, and drives said at least one inking unit roller at another relative speed in a second operating state.

2. The printing machine according to claim 1, including an electronic control for changing over said rotary drive of said inking unit roller from the differential speed to the other relative speed and/or from the other relative speed to the differential speed, depending upon the quantity of ink in the inking unit during the operating states.

3. The printing machine according to claim 2, wherein said electronic control device is linked controllingly with an infeed device for feeding printing ink to the inking unit, and serves for changing over said rotary drive of said at least one inking unit roller in time-dependence for activating said infeed device.

4. The printing machine according to claim 2, wherein said electronic control device controls a cleaning device for removing the printing ink from said inking unit, and controls the step of changing over said rotary drive of said inking unit roller in time-dependence for activating said cleaning device.

5. The printing machine according to claim 1, wherein said rotary drive of said inking unit roller is an individual electric motor drive controllable independently of a rotary drive of the printing form cylinder.

6. The printing machine according to claim 1, wherein said other relative speed of said inking unit roller corresponds to the peripheral speed of at least one other roller of the printing machine.

7. The printing machine according to claim 6, including a rotary drive for driving said at least one other roller, said rotary drive of said at least one other roller being controllable independently of a rotary drive of the plate cylinder, and being an individual electric motor drive linked controllingly with said electronic control.

8. The printing machine according to claim 7, wherein said rotary drive of said at least one:other roller is changeable over in a manner coordinated with said rotary drive of said at least one inking unit roller.

9. The printing machine according to claim 6, wherein said at least one other roller is an inking unit roller of the inking unit.

10. The printing machine according to claim 6, wherein said at least one other roller is a dampening unit roller of a dampening unit for dampening the printing form cylinder.

11. The printing machine according to claim 6, wherein said at least one other roller is a distributor roller oscillatable in the axial direction thereof.

12. The printing machine according to claim 6, wherein said at least one inking unit roller is a distributor roller oscillatable in the axial direction thereof.

13. The printing machine according to claim 6, wherein said at least one inking unit roller and said at least one other roller are engageable simultaneously with one and the same roller.

14. The printing machine according to claim 1, wherein the other relative speed is a synchronized speed synchronized with respect to the peripheral speed of said printing form cylinder.

15. The printing machine according to claim 1, wherein the other relative speed is a different differential speed different from the peripheral speed of said printing form cylinder.

16. A method of operating a printing machine, which comprises:

providing a printing form cylinder and an inking unit for inking the cylinder, the inking unit having at least one inking unit roller rotatably driven by a rotary drive;

rotatably driving the at least one inking unit roller at a first differential speed different from a peripheral speed of the printing form cylinder and at a second differential speed different from the peripheral speed of the printing form cylinder, in time-dependence upon various operating states of the inking unit.

17. The method according to claim 16, which further comprises driving the inking unit roller at the first differential speed in a first operating state, and at the second differential speed in a second operating state, depending upon the ink content of the inking unit, which is different in the respective operating states.

18. The method according to claim 16, which further comprises activating a cleaning device for removing a printing ink from the inking unit using an electronic control device; and performing a step of changing over the inking unit roller from the first differential speed to the second differential speed or from the second differential speed to the first differential speed, using the electronic control device in time-dependence for activating the cleaning device.

* * * * *